US005811894A

United States Patent [19]

Buyers et al.

[11] Patent Number: 5,811,894

[45] Date of Patent: Sep. 22, 1998

[54] SAFETY MODULE

[76] Inventors: Mark Buyers, 24 Devonshire Road; Simon Benedict Fraser, 8 Crimon Place, both of Aberdeen, Scotland

[21] Appl. No.: 682,443

[22] Filed: Jul. 17, 1996

[51] Int. Cl.[6] ..... G01V 1/42

[52] U.S. Cl. ..... 307/118; 340/853.1; 340/853.2; 340/856.1; 340/856.2; 200/82 A; 200/82 R

[58] Field of Search ..... 200/82 R, 82 A, 200/83 R, 83 J, 83 S, 83 SA; 340/603, 611, 626, 853.1, 853.2, 856.1, 856.2; 361/247, 248; 307/116, 117, 118, 112, 125, 132 M, 139, 144

[56] References Cited

U.S. PATENT DOCUMENTS

| | | | |
|---|---|---|---|
| 3,747,618 | 7/1973 | Boes | 137/80 |
| 3,760,362 | 9/1973 | Copland | 364/420 |
| 3,905,010 | 9/1975 | Fitzpatrick | 340/856.1 |
| 4,185,187 | 1/1980 | Rogers | 219/306 |
| 4,519,256 | 5/1985 | Daniels | 307/118 |
| 4,616,114 | 10/1986 | Strasser | 200/83 J |
| 4,751,400 | 6/1988 | Gath et al. | 307/118 |
| 4,790,378 | 12/1988 | Montgomery et al. | 166/66 |
| 4,803,483 | 2/1989 | Vandevier et al. | 340/856.1 |
| 4,879,439 | 11/1989 | Banus Garcia | 307/118 |
| 4,901,070 | 2/1990 | Vandevier | 340/856.1 |
| 4,967,047 | 10/1990 | Betterton et al. | 200/83 J |
| 5,062,275 | 11/1991 | Hirata et al. | 62/174 |
| 5,121,094 | 6/1992 | Ting et al. | 200/83 P |
| 5,281,782 | 1/1994 | Conatser | 200/83 J |
| 5,293,551 | 3/1994 | Perkins et al. | 361/195 |
| 5,578,993 | 11/1996 | Sitabkhan et al. | 340/614 |

*Primary Examiner*—William M. Shoop, Jr.
*Assistant Examiner*—Peter Ganjian
*Attorney, Agent, or Firm*—Madson & Metcalf

[57] ABSTRACT

A safety module which is intended to be used in an oil or gas production installation and to be lowered to a required depth with an electrically operable tool connected thereto, and which comprises a housing (2), a pressure sensitive switch (3) and a temperature sensitive switch in the housing which are adapted to switch at predetermined pressure and temperature values respectively, in which the pressure sensitive switch and the temperature sensitive switch only allow an electrical command signal to be conveyed to the tool when the pressure and temperature both reach the predetermined pressure and temperature values.

16 Claims, 2 Drawing Sheets

SAFETY MODULE

This invention relates to a safety module of the type for use with tools or instruments lowered into a borehole of an oil or gas production installation. The safety module of the invention is particularly, though not exclusively, suitable for protecting downhole tools or instruments from electrical interference or stray electrical signals.

During extraction of oil, gas or other fluids from an underground reservoir various tools or instruments are lowered into the borehole to perform tasks or to measure physical parameters. One technique sometimes used during extraction of fluids from an underground reservoir involves lowering an explosive charge or device to a specified depth. The device is lowered into the borehole on a conductive wireline down-which an electrical signal is sent to trigger the device once it is in the desired position. Once the device is activated one or more holes are blown in the production tubing. This allows a heavy "kill" fluid to be supplied to overbalance the pressure of the produced fluids and thereby restrict or prevent produced fluids rising up the production tubing.

However, this procedure can be very hazardous and existing techniques have a number of disadvantages. The explosive device is prone to being detonated by stray electrical signals, radio signals picked up by the conductive wireline, static electricity or lightning strikes. Any electrical noise or discharges from any of these sources can cause the device to explode prematurely with the risk of damage to the production system and danger to operators on the oil production installation.

In order to reduce the risk of premature detonation, it is common practice to short circuit the terminals of the cable drum at the surface to reduce the risk of stray signals causing the device to explode. However, although this reduces the risk of the device being activated accidentally, it is still possible for stray signals, for example, from radio signals picked up by the wireline to cause the device to explode. The length of wireline conductor lowered into the production tubing is very long and acts as a giant aerial for radio signals. It is a standard requirement that "radio silence" is maintained whilst the device is being lowered into the well. This can be inconvenient and time consuming as many radio systems, including portable radio systems, are used on the site, and each must be located and switched off before the operation can begin.

The safety module of the invention seeks to overcome the disadvantages of known wireline systems by providing a safety module which controls operation of, for example, an explosive device or other tool lowered into the well, and with a view to preventing premature operation by spurious signals and before the tool has been lowered to required depth.

SUMMARY OF THE INVENTION

According to one aspect of the invention there is provided a safety module to be lowered to a required depth with an electrically operable tool connected thereto, said module comprising in an oil or gas production installation:

a housing;

a pressure sensitive switch in the housing for switching at a predetermined pressure value; and a temperature sensitive switch in the housing for switching at a predetermined temperature value;

wherein said pressure sensitive switch and the temperature sensitive switch only allow an electrical command signal to be conveyed to the tool when the pressure and temperature both reach the predetermined pressure and temperature values.

The temperature and pressure in an oil production well are both closely related to depth from the surface. The safety module of the invention has the advantage that it is located intermediate of, for example, an explosive device and the wireline conducting cable. The safety module will only permit an activating electrical signal to pass to the device when preset conditions are satisfied ie. when the device has been lowered to a desired depth where the temperature and pressure conditions are satisfied. This means that until those pressure and temperature conditions are satisfied the device connected to the safety module cannot be accidentally activated. This makes the operation of lowering equipment, particularly explosive devices, into the production tubing much safer. Furthermore, it is not necessary to maintain "radio silence" while the device is being lowered into the production tubing. Small variations in either the temperature or the pressure may be encountered as the tool is lowered into the well. The use of a double switch system based on a temperature switch and a pressure switch virtually eliminates the risk of the cable being electrically connected to the device before it has been lowered to the required depth.

Furthermore, in the event of retrieval of the safety module being required for any reason, (before required initiation of its operation), the module may be returned safely to surface, substantially without risk of initiation by spurious signals, in that the switches can revert to closed circuit status as the module rises to the surface.

Preferably, a conducting wireline cable coupled to the module is short circuited to the housing by one of the switches when one of the said temperature or pressure quantities is below the predetermined value. This further enhances the safety capability of the device by ensuring that the conducting wireline cable is short circuited both at the cable drum on the surface and at its connection to the safety module. Any spurious electrical signals which might be caused by radio signals, static or lightening are less likely to affect the device connected to the safety module.

The pressure sensitive switch may comprise a contact member located within a cylinder and a piston slidable within said cylinder, the piston adapted to make electrical contact between the contact member and the housing when the pressure is below the predetermined value thereby short circuiting said first terminal. Once the pressure reaches or exceeds the predetermined value the piston moves away from the contact member thereby breaking the electrical connection between the terminal and the housing. This ensures that any signal which passes down the wireline cable can be transmitted to the device, via the safety module.

Preferably, the temperature sensitive switch comprises a magnetic reed switch. The preferred magnetic reed switch may include magnets of a ferrite material with a Curie temperature selected at the predetermined value. An advantage of this type of reed switch is that it is enclosed in a hermetically sealed container and surrounded by inert gas.

Preferably, the temperature sensitive switch is a bimetallic reed switch.

Preferably, the temperature sensitive switch is a semiconductor switch. Semiconductor switches are very small and are suitable for use in a safety module where space within the housing is limited.

The pressure sensitive switch may be adjustable. An adjustable switch allows an operator to set the switch to activate at a desired depth. As the depth to which the device is lowered will vary from well to well, and from the particular physical characteristics of the well, it is desirable to have an adjustable safety module which can operate over a range of depths.

The temperature sensitive switch may be adjustable.

The pressure sensitive switch may include a resilient member for controlling movement of the piston relative to the contact member. The resilient member may be a calibrated spring which is selected to maintain the piston in contact with the contact member until the pressure reaches a predetermined value.

Preferably, the resilient member can be adjusted to allow a range of predetermined pressure values to be selected by an operator.

Generally, the safety module further includes switching means comprising:

a pressure sensor and temperature sensor connected to an analogue to digital convertor;

a micro-controller connected to the analogue to digital convertor for monitoring signals relating to pressure, temperature and time elapsed; and an electronic switch connected to said micro-controller; wherein the micro-controller controls the electronic switch according to the combination of said signals detected. The switching means provides a further system for controlling a device lowered on a conducting wireline. The micro-controller monitors the time, pressure and temperature and is programmed to activate the electronic switch in response to a particular set of conditions detected. During lowering of the safety module and, for example, an explosive device into the well it might be necessary to conduct a pressure test. This might activate the pressure sensitive switch but the switching means would prevent activation of the explosive device. The switching means can be arranged to monitor the rate of change of pressure or temperature as well as the absolute values, or for example, monitor deliberate changes in the pressure of the fluid in the well.

Preferably, the switching means further includes an interface and memory for inputting and storing preset values, said values being used by the micro-controller to determine when the electronic switch is to be activated.

Conveniently, the switching means is powered by a battery. This eliminates the need to supply power to the switching means from the surface which, with its long connecting cables to the surface, might risk accidental operation of the device by spurious electrical signals.

Preferably, the tool to be coupled with the safety module comprises an electric detonator and an explosive charge. Upon activation of the actuator the electric detonator causes the charge to detonate thereby perforating the production tubing to "kill" the well.

According to a third aspect of the invention there is provided a method of protecting a remotely operable downhole tool from stray electrical signals while being lowered into a well which comprises:

connecting a wireline cable to a first terminal located within a safety module;

connecting a downhole tool, to be lowered into the well, to a second terminal within the safety module, and lowering the tool and safety module assembly into the well; wherein the safety module comprises a housing, the first terminal and second terminals, and a pressure sensitive switch electrically connected between the terminals, for switching at a predetermined pressure value; and a temperature sensitive switch connected between the terminals, said temperature sensitive switch for switching at a predetermined temperature value; wherein said pressure sensitive switch and the temperature sensitive switch complete an electrical connection between the terminals when the pressure and temperature both reach the predetermined pressure and temperature values. As the tool is lowered into the well the pressure and temperature increase. At preset values the pressure switch and temperature switch operate to enable a "command" electrical signal i.e. a deliberate signal to be sent to the tool through the safety module.

Preferably, the first terminal is short circuited to the housing when one of the said temperature or pressure quantities is below the predetermined value.

DESCRIPTION OF PREFERRED EMBODIMENT

Figure 1:
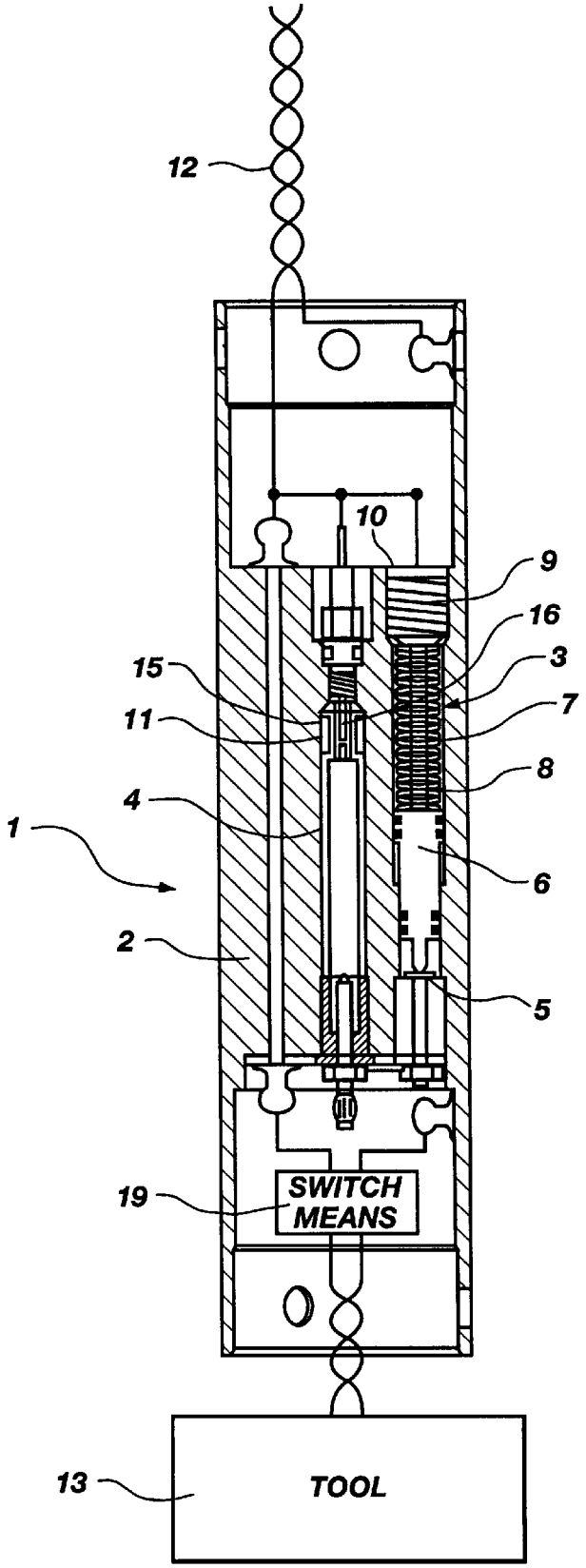
FIG. 1 is a cross-sectional view of a safety module according to the invention; and, FIG. 2 is a circuit block diagram of switching means for use in a safety module.
Figure 2:
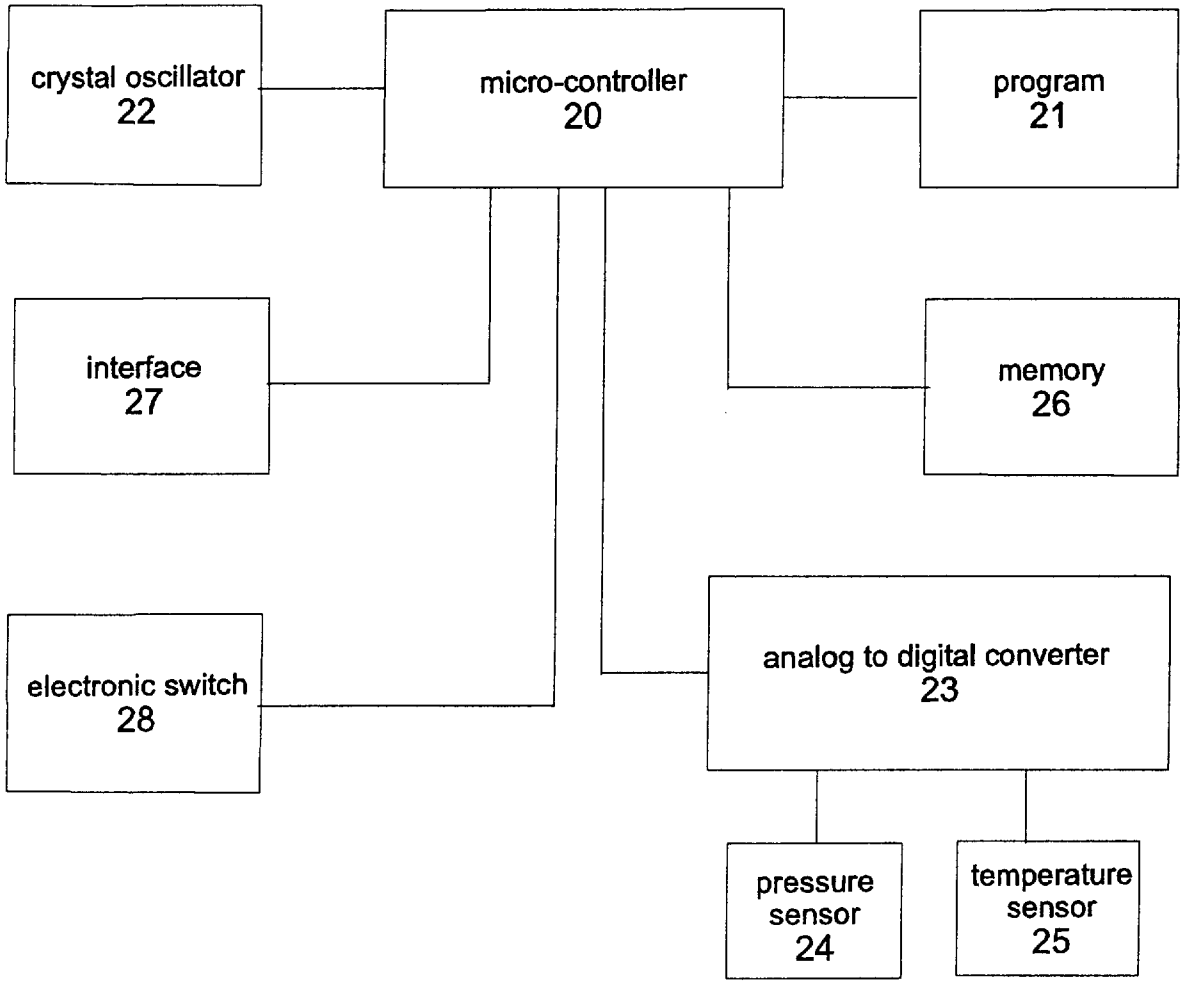

Referring to the drawings in detail, FIG. 1 shows a safety module according to the invention, generally indicated by reference numeral 1, which comprises a housing 2 containing a pressure sensitive switch 3 and a temperature sensitive switch 4 and which are connected in parallel.

The pressure sensitive switch 3 comprises a contact member 5, a piston 6 slidable within a cylinder 7 and a spring 8 which urges the piston 6 into contact with the contact member 5. The physical characteristics and parameters of the spring 8 is known. Disc springs 9 may be added or removed from the chamber 10 to alter the pressure applied to the piston 6 which in turn sets the predetermined pressure value at which the pressure sensitive switch is activated. Below the predetermined pressure value the piston 6 is in contact with the member 5 thereby providing a short circuit which provides protection against stray electrical signals in the wireline from passing through the safety module to the tool or instrument below.

The temperature sensitive switch (not shown in detail) is a magnetic reed type switch. At the Curie temperature the switch 11, comprising a bimetallic strip 16 and ferrite magnets 15 changes state and the short circuit is removed.

In use a conducting wireline cable 12 is connected to the safety module and an electrically operated tool 13 for example, an explosive device is also connected thereto. The terminals at the surface are short circuited. The combination is then lowered into the well to the desired depth. A casing collar locator tool may be used to monitor the depth to which the apparatus has been lowered. As the safety module and tool are lowered the pressure and temperature of fluid in contact with the apparatus rises. However, below the predetermined pressure and temperature values the tool is isolated from the wireline cable thereby preventing any stray or spurious electrical signals from activating the tool and prematurely detonating the device. Furthermore, below the predetermined pressure value the wireline cable is also short circuited. Once the device reaches a depth in the well where the predetermined values are exceeded the piston 6 moves away from the contact member 5 and ceases to short circuit the wireline cable. The temperature sensitive switch is activated and an electrical signal can be transmitted down the wireline cable through the safety module to the tool.

In an enhanced version of safety module, switching means 19 is provided comprises a micro-controller 20, controlled by a program 21, is connected to a crystal oscillator 22, interface 27, electronic switch 28 and memory 26. A pressure sensor 24 and temperature sensor 25 are connected to an analogue to digital convertor 23 which in turn is connected to the micro-controller 20. The micro-controller monitors time, pressure and temperature and activates the electronic switch 28 when predefined conditions are met. The switching means is powered by its own battery thereby eliminating the need to supply power from the surface. The electronic switch is a bi-stable relay but other electronic switch devices well known to the skilled man could be used, for example, a MOSFET, thyristor, other semiconductor devices, or an electromechanical device such as a relay. The interface 27 permits an operator to enter parameters for controlling the way the switching means operates and for defining the pre-determined pressure, temperature and time values.

The switching means can be used to operate the safety module in a number of different ways. Examples of five methods which could be used are briefly discussed below:

Method A: Timer+Temperature+Pressure

After a pre-determined time delay, the control section waits until first the preset temperature and then the preset pressure threshold are exceeded. The pressure threshold can be the result simply of depth, or can be depth plus applied surface pressure.

Method B: Timer+Temperature+Pressure+Pulse

As with method A, but with the additional feature that the control section will wait until a pressure signal or signals of particular height and duration is detected.

Method C: Timer+Pressure+Temperature+Window

As with method A, but with the additional feature that the switch stays open for a limited period, either as determined by Pressure/Temperature thresholds, or for a fixed period of time.

Method D: Timer+Pressure+Temperature+Pulse+Window

As with method B, but with the additional features described in method C.

Method E: surface electric control

As with any of the above method but with an additional parallel high-resistance switch. This will allow a small voltage to be developed across the switch which can in turn be utilised to communicate from the surface to the downhole module and to finally enable the system by opening this last switch.

There are described above use of a single pressure and temperature switches series in parallel, but parallel combinations of more than two such switches may be used. These combinations render possible an operating "window" rather than singly predetermined thresholds at which the switches respond.

We claim:

1. A safety module for use in an oil or gas production installation and intended to be lowered to a required depth with an electrically operable tool connected thereto, said module comprising:

a housing;

a pressure sensitive switch in the housing for switching at a predetermined pressure value; and, a temperature sensitive switch in the housing for switching at a predetermined temperature value;

wherein said pressure sensitive switch and said temperature sensitive switch only allow an electrical command signal to be conveyed to the tool when the pressure and temperature both reach the predetermined pressure and temperature values.

2. A safety module according to claim 1, further comprising a conducting wireline cable which is coupled to the module and is short circuited to the housing by one of said switches when one of said temperature or pressure quantities is below the predetermined value.

3. A safety module according to claim 1, in which the pressure sensitive switch comprises a contact member located within a cylinder and a piston slidable within said cylinder, the piston to make electrical contact between the contact member and the housing when the pressure is below the predetermined value.

4. A safety module according to claim 3, in which the pressure sensitive switch includes a resilient member for controlling movement of the piston relative to the contact member.

5. A safety module according to claim 4, in which the resilient member comprises a calibrated spring which is selected to maintain the piston in contact with the contact member until the pressure reaches a predetermined value.

6. A safety module according to claim 5, in which the resilient member is adjustable to allow a range of predetermined pressure values to be selected by an operator.

7. A safety module according to claim 1, in which the temperature sensitive switch comprises a magnetic reed switch.

8. A safety module according to claim 7, in which the magnetic reed switch includes magnets of a ferrite material with a Curie temperature selected at the predetermined value.

9. A safety module according to claim 8, in which the temperature sensitive switch is a bimetallic reed switch.

10. A safety module according to claim 1, in which the pressure sensitive switch is adjustable to allow an operator to set the switch to activate at a desired depth.

11. A safety module according to claim 1, and further including switching means, which comprises:

a pressure sensor and temperature sensor connected to an analogue to digital converter;

a micro-controller connected to the analogue to digital converter for monitoring signals relating to pressure, temperature and time elapsed; and, an electronic switch connected to said micro-controller; wherein the micro-controller controls the electronic switch according to the combination of said signals detected.

12. A safety module according to claim 11, in which the switching means further includes an interface and memory for inputting and storing pre-set values, said values being used by the micro-controller to determine when the electronic switch is to be activated.

13. A safety module according to claim 12, in which the switching means is powered by a battery.

14. A safety module according to claim 1, in which the tool coupled with the safety module comprises an electric detonator and an explosive charge.

15. A method of protecting a remotely operable downhole tool from stray electrical signals while being lowered into a well which comprises:

connecting a wireline cable to a first terminal located within a safety module;

connecting a downhole tool to be lowered into the well, to a second terminal within the safety module; and then lowering the tool and safety module assembly into the well;

wherein the safety module comprises:

a housing, said first and second terminals, and a pressure sensitive switch electrically connected between the terminals for switching at a predetermined pressure value; and, a temperature sensitive switch connected between said terminals for switching at a predetermined temperature value;

and wherein said pressure sensitive switch and said temperature sensitive switch complete an electrical connection between the terminals when the pressure and temperature both reach the predetermined pressure and temperature values so that, as the tool is lowered into the well, the pressure and temperature increase and at pre-set values the pressure switch and temperature switch operate to enable a command electrical signal to be sent to the tool through the safety module.

16. A method according to claim 15, in which the first terminal is short circuited to the housing when one of said temperature or pressure quantities is below the predetermined value.

* * * * *

US005811894B1

(12) REEXAMINATION CERTIFICATE (4431st)

United States Patent

Buyers et al.

(10) Number: US 5,811,894 C1

(45) Certificate Issued: Aug. 28, 2001

(54) SAFETY MODULE

(75) Inventors: Mark Buyers, 24 Devonshire Road; Simon Benedict Fraser, 8 Crimon Place, both of Aberdeen (GB)

(73) Assignees: Mark Buyers; Simon Benedict Fraser, both of Aberdeen (GB)

Reexamination Request:
No. 90/005,300, Apr. 12, 1999

Reexamination Certificate for:

| | |
|---|---|
| Patent No.: | **5,811,894** |
| Issued: | **Sep. 22, 1998** |
| Appl. No.: | **08/682,443** |
| Filed: | **Jul. 17, 1996** |

(51) Int. Cl.[7] ..... G01V 1/42

(52) U.S. Cl. ..... 307/118; 200/82 R; 200/82 A; 340/853.1; 340/853.2; 340/856.1; 340/856.2

(58) Field of Search ..... 307/116, 117, 307/112, 118, 125, 130, 144; 200/81 R, 82 R, 334; 175/4, 2, 4.56

(56) References Cited

U.S. PATENT DOCUMENTS 4,306,628 * 12/1981 Adams, Jr. et al. ..... 175/4.56
4,971,160 * 11/1990 Upchurch ..... 175/4.54
5,101,907 * 4/1992 Schultz et al. ..... 166/386
5,165,489 * 11/1992 Langston ..... 175/4.54
5,237,136 * 8/1993 Langston ..... 200/81
5,490,564 * 2/1996 Schultz et al. ..... 166/374

FOREIGN PATENT DOCUMENTS

2280013 * 1/1995 (GB) .

* cited by examiner

*Primary Examiner*—Fritz Fleming

(57) ABSTRACT

A safety module which is intended to be used in an oil or gas production installation and to be lowered to a required depth with an electrically operable tool connected thereto, and which comprises a housing (2), a pressure sensitive switch (3) and a temperature sensitive switch in the housing which are adapted to switch at predetermined pressure and temperature values respectively, in which the pressure sensitive switch and the temperature sensitive switch only allow an electrical command signal to be conveyed to the tool when the pressure and temperature both reach the predetermined pressure and temperature values.

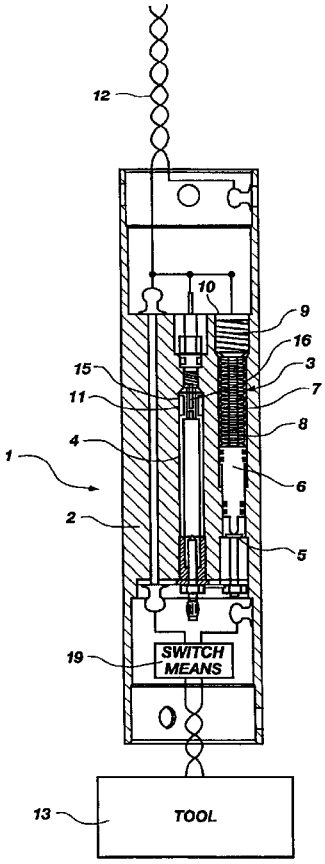

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–16 are cancelled.

* * * * *